US010918921B2

(12) United States Patent
White

(10) Patent No.: US 10,918,921 B2
(45) Date of Patent: Feb. 16, 2021

(54) SPRING-LOADED INFINITE ADJUST BASKETBALL LIFT SYSTEM

(71) Applicant: Russell Brands, LLC, Bowling Green, KY (US)

(72) Inventor: Ronald White, Bowling Green, KY (US)

(73) Assignee: Russell Brands, LLC, Bowling Green, KY (US)

( * ) Notice: Subject to any disclaimer, the term of this patent is extended or adjusted under 35 U.S.C. 154(b) by 0 days.

(21) Appl. No.: 16/150,027

(22) Filed: Oct. 2, 2018

(65) Prior Publication Data

US 2019/0262681 A1 Aug. 29, 2019

Related U.S. Application Data

(60) Provisional application No. 62/635,127, filed on Feb. 26, 2018.

(51) Int. Cl.
*A63B 63/08* (2006.01)

(52) U.S. Cl.
CPC ..... *A63B 63/083* (2013.01); *A63B 2225/093* (2013.01)

(58) Field of Classification Search
CPC ..... A63B 2225/093; A63B 63/083
USPC ..... 473/483, 484
See application file for complete search history.

(56) References Cited

U.S. PATENT DOCUMENTS

D350,797 S 9/1994 Curtis
5,695,417 A 12/1997 Winter et al.
6,077,177 A 6/2000 Winter et al.
6,120,396 A 9/2000 Van Nimwegen et al.
6,273,834 B1 8/2001 Winter
6,402,644 B2 * 6/2002 Stanford ..... A63B 63/083 248/280.11
6,419,598 B1 * 7/2002 Winter ..... A63B 63/083 248/280.11
6,422,957 B1 * 7/2002 Winter ..... A63B 63/083 248/274.1
6,488,599 B2 12/2002 Nye
6,645,095 B1 * 11/2003 Nye ..... A63B 63/083 248/274.1
6,932,725 B2 * 8/2005 Monsen ..... A63B 63/083 248/280.11
7,331,883 B2 * 2/2008 Goldberg ..... A63B 63/083 473/483
7,775,917 B2 * 8/2010 Nye ..... A63B 63/083 248/281.11
8,062,152 B2 * 11/2011 Nye ..... A63B 63/083 473/484
8,172,706 B2 * 5/2012 Peery ..... A63B 63/083 473/483

(Continued)

*Primary Examiner* — Laura Davison

(74) *Attorney, Agent, or Firm* — Jacob W Neu; Bradley Arant Boult Cummings, LLP

(57) ABSTRACT

A movable elevator assembly for adjusting the height of a basketball goal is provided herein. The elevator assembly includes a first strut and a second strut. A locking assembly is attached to the second strut and is movable along the fixed first strut. The locking assembly includes a lock, such as a spring that grips the lower strut in a rest position and can be activate to release the first strut. By moving the lock up or down the fixed strut, the height of the basketball goal can be moved up or down. This allows a user to select any desired height for the basketball goal.

3 Claims, 5 Drawing Sheets

(56) References Cited

U.S. PATENT DOCUMENTS

| | | | | |
|---|---|---|---|---|
| 8,708,844 | B2 * | 4/2014 | Nye | A63B 63/083 473/484 |
| 8,992,350 | B2 * | 3/2015 | Green | A63B 63/083 473/484 |
| 2001/0024984 | A1 * | 9/2001 | Stanford | A63B 63/083 473/484 |

* cited by examiner

SPRING-LOADED INFINITE ADJUST BASKETBALL LIFT SYSTEM

FIELD OF INVENTION

This invention concerns a lift or elevator assembly for an adjustable basketball backboard system.

BACKGROUND ART

Basketball goal assemblies are used to provide a basketball goal and backboard a set distance above the ground. While regulated basketball games set the height of the goal at 10 feet above the basketball court, basketball goal assemblies used in informal or recreational play may be disposed at various height locations. For such assemblies, a lift mechanism or subassembly is used to set the goal to a desired height. Prior lift mechanisms include a vertical bar with notches set at predetermined locations that correspond to discrete heights of the goal. A user sets a horizontal bar into the notch corresponding to the desired height. However, such systems allow a user to only set the goal to a few predetermined heights based on the location of the notches.

A variable-length, locking gas strut has been used to overcome this problem and allow for a sliding height adjustment providing an infinite number of potential height locations. However, the gas strut is prone to leaking over time. This causes two problems. First, the strut can stick and become difficult to move. Second, the strut may unexpectedly release during play, which may be dangerous to those around the backboard.

What is needed, then, is a variable lift mechanism that allows for infinite height locations and that does not require a gas strut.

SUMMARY OF INVENTION

A basketball goal system having a base supporting a pole, a backboard support assembly having a top arm with a proximal end coupled to a backboard and a distal end rotatably connected to the pole, and a bottom arm with a proximal end coupled to a backboard and a middle section rotatably coupled to the pole, an elevator assembly having a lower strut having a lower end affixed to the pole, a spring assembly having a spring expandably coiled around the lower strut, and a housing containing the spring, an upper strut having an upper end rotatably connected to a distal end of the bottom arm and a lower end coupled to the housing, and a handle pivotally attached to the pole and pivotally attached to the housing, and having a spring trigger configured to expand the spring when triggered and contract the spring when released.

A height-adjustable basketball goal system having a vertical support, a backboard assembly having a goal, and an elevator assembly, the elevator assembly having a lower strut attached to the vertical support, a locking assembly comprising a lock adapted to grip the lower strut in a rest position and to release the lower strut in an activated position, an upper strut connected to the locking assembly and pivotally connected to the backboard assembly; and a handle rotatably attached to the pole and comprising a trigger adapted to move the lock from a rest position to an activated position when gripped by a user, wherein when the handle is rotated upward, the goal moves from a first position to a second position, and when the handle is rotated downward, the goal moves from the second position to the first position.

A height-adjustable basketball goal system having a pole, a backboard assembly supported by the pole and having a goal, and an elevator assembly, the elevator assembly having a lower strut having a first end attached to the pole; a spring assembly comprising a spring expandably coiled around the lower strut, an upper strut connected at a first end to the spring assembly and at a second end to the backboard assembly, and a handle rotatably attached to the pole and comprising a trigger adapted to expand the spring when gripped and contract the spring when released.

DETAILED DESCRIPTION

Figure 1:
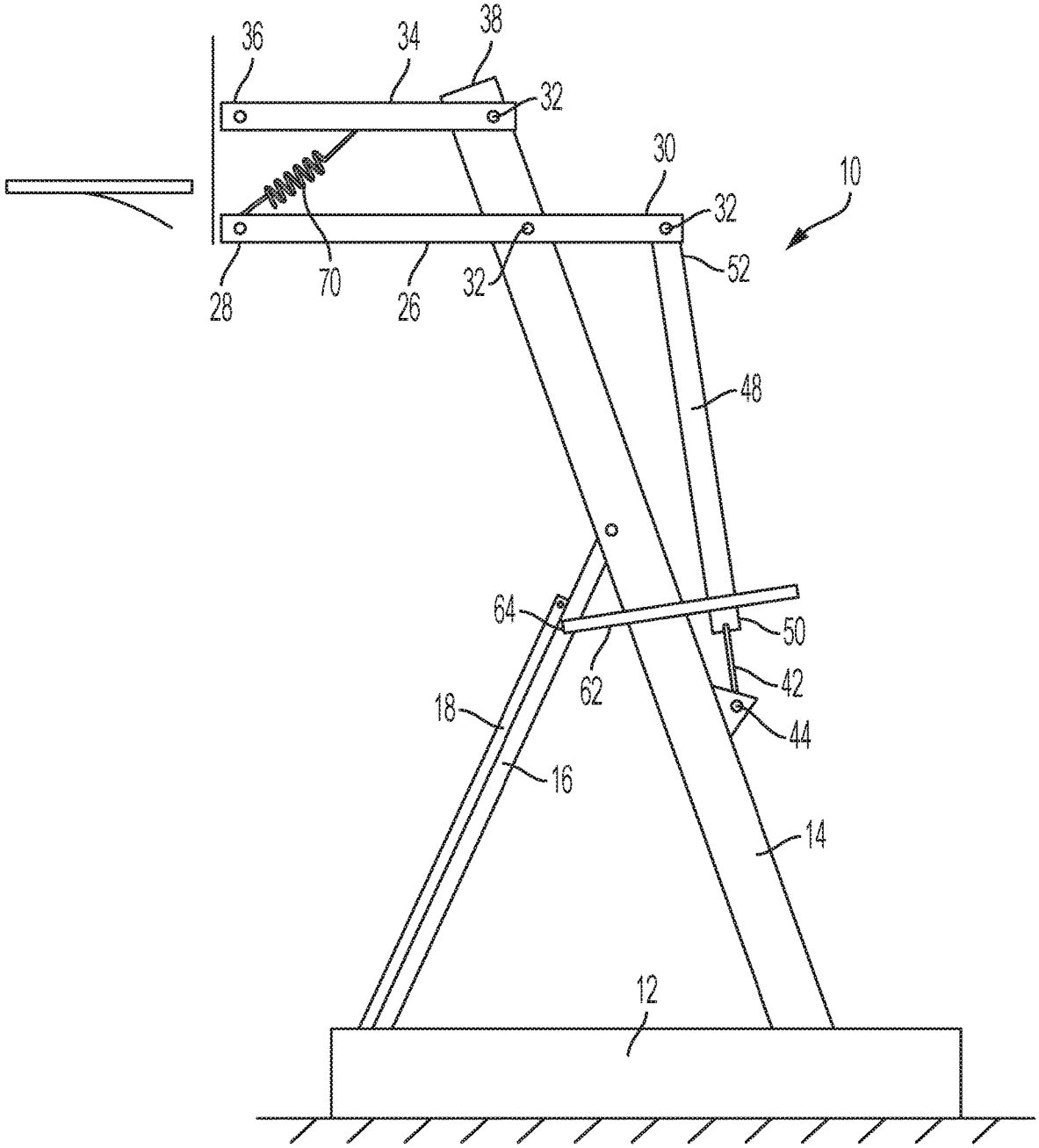
FIG. 1 depicts an embodiment of the lift system disclosed herein.

Applicant discloses herein a basketball goal assembly 10, an embodiment of which is depicted in FIG. 1. Generally, a basketball goal assembly 10 has a vertical support, such as a pole 14 as depicted in FIG. 1, with a backboard assembly 20 attached at its proximal end to the top of the pole 14. The backboard assembly 20 has a backboard with a goal or rim at the distal end of the backboard assembly 20.

More particularly focusing on the vertical support, the pole 14 of vertical support may be secured in-place directly in the ground, or it may be attached to and situated on a base 12. The pole 14 may be substantially vertical, or it may lean forward and be supported by additional support struts 16, as shown in FIG. 1. The pole 14 is rigid and may be formed as a single piece or have multiple parts that are fit into each other. Some embodiments may also include a portable base 12. Such a portable base 12 typically has wheels to allow the base 12 to be moved into a desired location. The portable base 12 may also include ballast, such as sand or water, to provide a counterweight for stabilizing the entire basketball goal assembly 10. A cover 18 may also be provided to cover the struts 16, pole 14, and/or base 12. In other embodiments the pole 14 may be substantially vertical and sunk in concrete poured into the ground. In such embodiments a base, supporting struts, and/or a cover may be absent.

The backboard assembly 20 is connected to the top of and extends away from the pole 14. The backboard assembly 20 includes at least one primary arm 26 that is attached to the pole 14 by a pin 32 in the middle portion of the primary arm 26. The distal end 28 of the primary arm 26 is secured to and supports the backboard 24 by screws, bolts, welding, or other permanent or semi-permanent fasteners. The proximal end 30 of the arm 26 extends some distance behind the pole 14 in the opposite direction from the backboard 24. The primary arm 26 may be a single beam, or it may be multiple beams (e.g., one on each side of the pole 14 to provide a pair of beams as the arm 26) and attached to and supporting the backboard 24 at multiple points. The beams of the primary arm 26 may be curved or straight as desired. In some embodiments, the backboard assembly 20 may also include one or more additional arms 34 such as that shown in FIG. 1. Such additional arms provide further support and stability to the backboard 24. In the embodiment depicted in FIG. 1, additional arm 34 at the distal end 36 is attached to and secures the backboard 24 in the same manner as the primary arm 26. The proximal end 38 of the additional arm 34 is attached with a pin 32 at the top of the pole 14. In other embodiments, the proximal end 38 of the additional arm 34 may also extend backwards behind the pole 14, as does the primary arm 26. In addition, like the primary arm 26, the one or more additional arms 34 may be formed of one or more beams for securing and stabilizing the backboard 24.

The lift or elevator assembly allows a user to adjust the height of the basketball backboard 24. In general, the elevator assembly has a lower strut 42, an upper strut 48, and a locking assembly 54. The bottom end 44 of the lower strut 42 is fixedly attached to the pole 14. Preferably the lower strut 42 is secured such that the locking assembly 54 and the handle 62 (described below) are positioned at a comfortable height for the user. The top end 46 of the lower strut 42 is left free. It may be left uncovered, covered by a sheath, or hidden inside the upper strut 48 if the upper strut 48 is hollow and situated over the lower strut 46.

Figure 2:
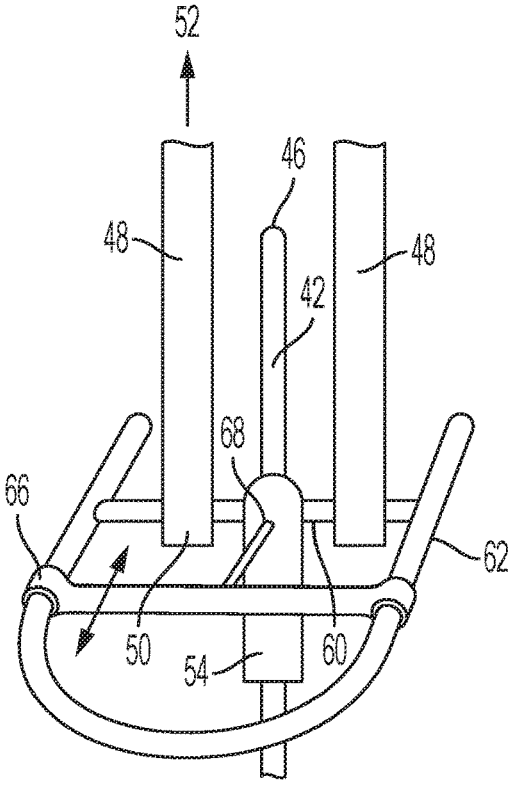
FIG. 2 depicts a close-up perspective view of the handle and lift assembly according to an embodiment of the lift system disclosed herein.

FIG. 2 provides a close-up view of the lock housing 54 and other portions of the elevator assembly. A lock housing 54 is slidably attached to the lower strut 42. The lower end 50 of the upper strut 48 is secured to the housing. As shown in FIG. 2, there are two upper struts 48, one on each side of the lock housing 54, and a bar 60 intersects each upper strut 48 and the lock housing 54 to secure the components together. Although the embodiment shown in FIG. 2 includes two upper struts 48, other embodiments may include only one upper strut 48. For example, there may be an upper strut 48 on only one side of the lock housing 54. As another example, the upper strut 48 may be hollow inside and slide over the upper end 46 of the lower strut 42, such that it continues along the same longitudinal axis as the lower strut 42. In such an embodiment the upper strut 48 may secure directly into the lock housing 54. The upper end 52 of the upper strut 48 is connected by a rotatable pin 32 to the proximal end 30 of the primary arm 26. Thus, as the upper strut 46 moves up or down, the primary arm 26 moves the backboard assembly up or down as well. In the embodiment depicted in FIG. 1, as the upper strut 48 moves up, the primary arm 26 rotates about the pin 32 pinning the primary arm 26 to the pole 14 such that the backboard 24 moves down. In reverse, as the upper strut moves down, the backboard 24 moves up.

Figure 3A:
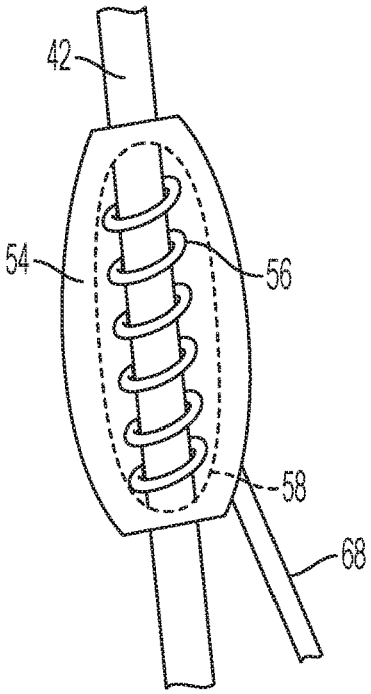
FIGS. 3A and 3B depict a spring locking mechanism according to an embodiment of the lift system disclosed herein.
Figure 3B:
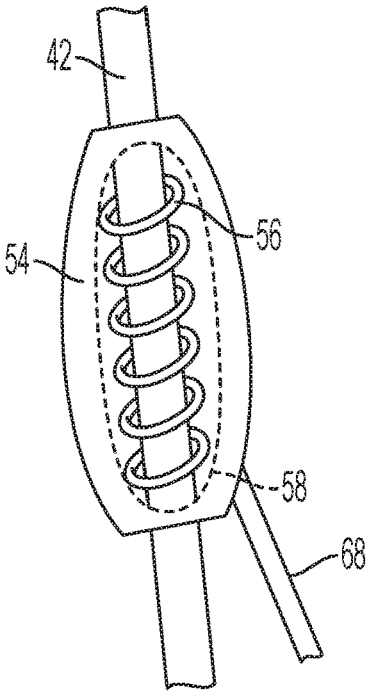

FIG. 3 depicts the interior of the lock housing 54. The lock as depicted in this embodiment is a spring 56 coiled around the lower strut 42. The spring 56 has a resting inner diameter that is less than the diameter of the lower strut 42, such that when applied around the lower strut 42, the spring 56 naturally coils tightly around the lower strut 42. Accordingly, in the resting position the spring 56 applies a normal force inwardly against the lower strut 42, creating a static frictional force that locks the spring 56 into place and prevents slipping. Because one end of the spring 56 is secured to the housing 54, the locked spring 56 supports the housing 54, and by extension the upper strut 48 and other components of the basketball goal assembly 10, locked in place during use. Accordingly, the spring 56 must be of a sufficient length, diameter, and number of coils to result in a strong normal force against the lower strut 42 to generate enough frictional force to lock the assembly in place. As a non-limiting example, one or more springs approximately 1 inch (25.4 mm) long having approximately 17 coils of 0.055 inch (1.4 mm) diameter wire, and having an outer coil diameter of approximately 0.60 inches (15 mm) and coiled to apply around a 0.40 inch (10 mm) rod can maintain a load of 2000 lbs (900 kg). Other diameters, sizes or weight ratings may be selected based on particular design or performance requirements.

Figure 4:
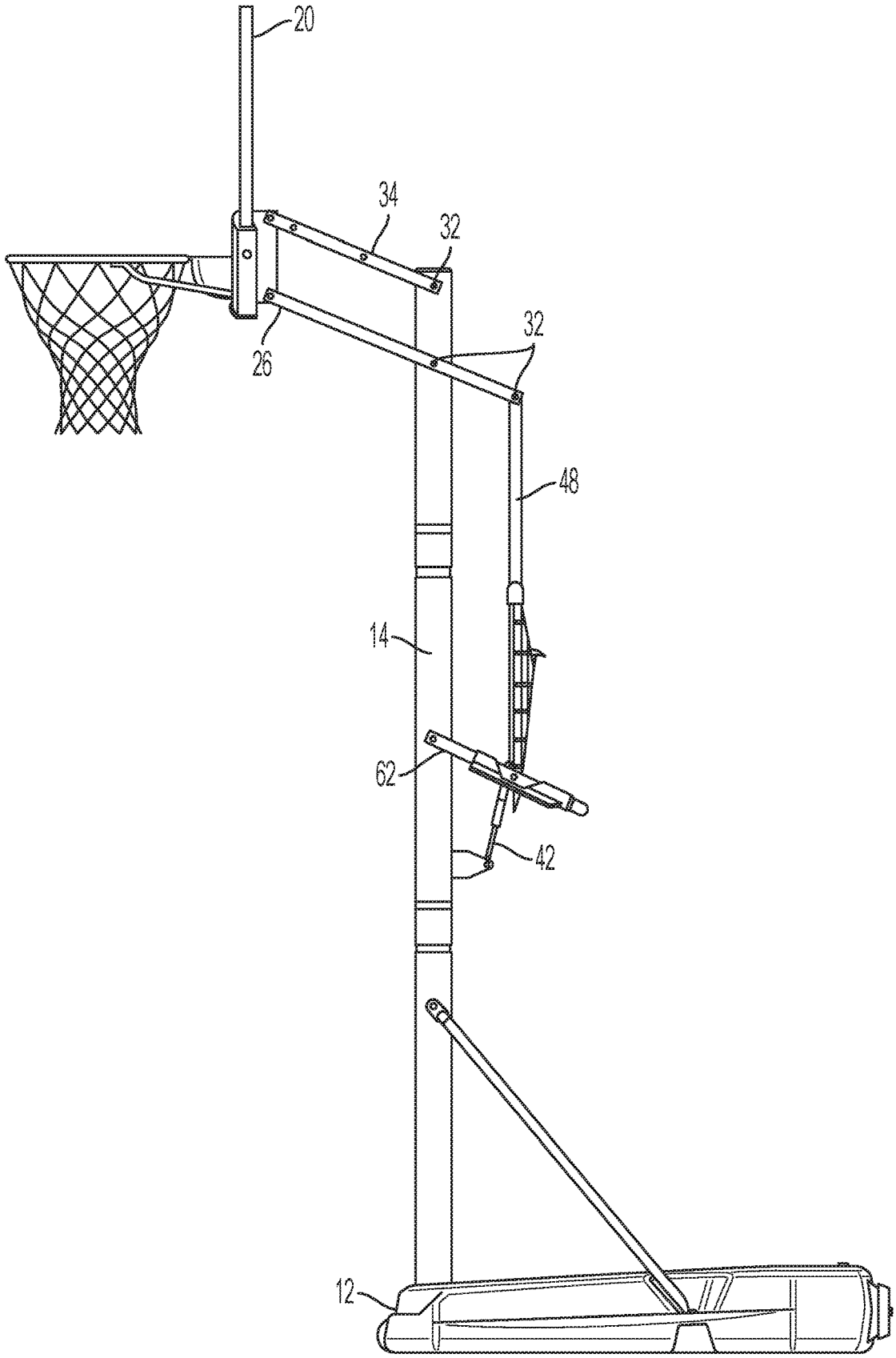
FIG. 4 depicts another embodiment of the lift system disclosed herein.

The locking mechanism can also include other variations. For example, as shown in FIG. 4, in some embodiments the lock may be a clamp that grips the lower strut 42 with sufficient normal force to generate the necessary frictional force for holding the assembly at the desired height. A lock may also include some combination of springs and/or clamps.

Returning to FIG. 3, the second end of the spring 56 is free to be pushed or pulled in order to expand or contract the spring 56. This end of the spring 56 may in some embodiments have an activator 58 that attaches to the spring and coordinates with a piston 68. In other embodiments, the piston 68 may attach directly to the spring 56. The piston 68 engages a handle 62 that includes a trigger 66. In some embodiments, the trigger 66 is located on the handle 62 such that a user can grab the handle 62 and the trigger 66 with one hand. In other embodiments the trigger 66 may be activated by a second hand. As shown in FIG. 3, the handle 62 is attached to the pole struts 16 and forms a U shape extended backwards away from the pole 14. In other embodiments, the handle 62 may be attached directly to the pole 14. The handle 62 may also be a bar, rather than a U shape. The handle 62 extends further from the pole 14 than the lower strut 42 and housing 54. When the handle 62 is gripped and the trigger 66 is pulled, the trigger 66 moves the piston 68 to push the spring 56 to an open expanded position. If a clamp lock is used instead of a spring, the clamp is pushed to an open position. Once the spring 56 is in this open position, the housing 54 is free to slide along the lower strut 42. As the handle 62 is rotated upward, the housing 54 slides upward along the lower strut 42, thereby moving the upper strut 48 and the backboard assembly 20 to a new vertical position. Similarly, as the handle 62 is rotated downward, the housing 54 slides downward along the lower strut 42. In this way, the user may move the backboard 24 to any desired height permitted by the range of movement of the housing 54 along the lower strut 42. Once the desired height is reached, the user stops moving the handle 62 and releases the trigger 66. Upon releasing the trigger, the spring 56 moves back to its original position and coils tightly around the lower strut 42.

The lower strut 42 may also be marked to indicate the location where the basketball backboard 24 or goal 22 are at a specific height above the ground. For example, markings may be made to indicate the location to set the goal 22 at 8 feet, 8.5 feet, 9 feet, 9.5 feet, and 10 feet. However, the user may adjust the height to any height in the range, not simply those that are marked at preselected intervals.

Another embodiment is depicted in FIG. 4. Here, the handle 62 is attached directly to the pole 14, rather than supporting pole struts 64.

Figure 5:
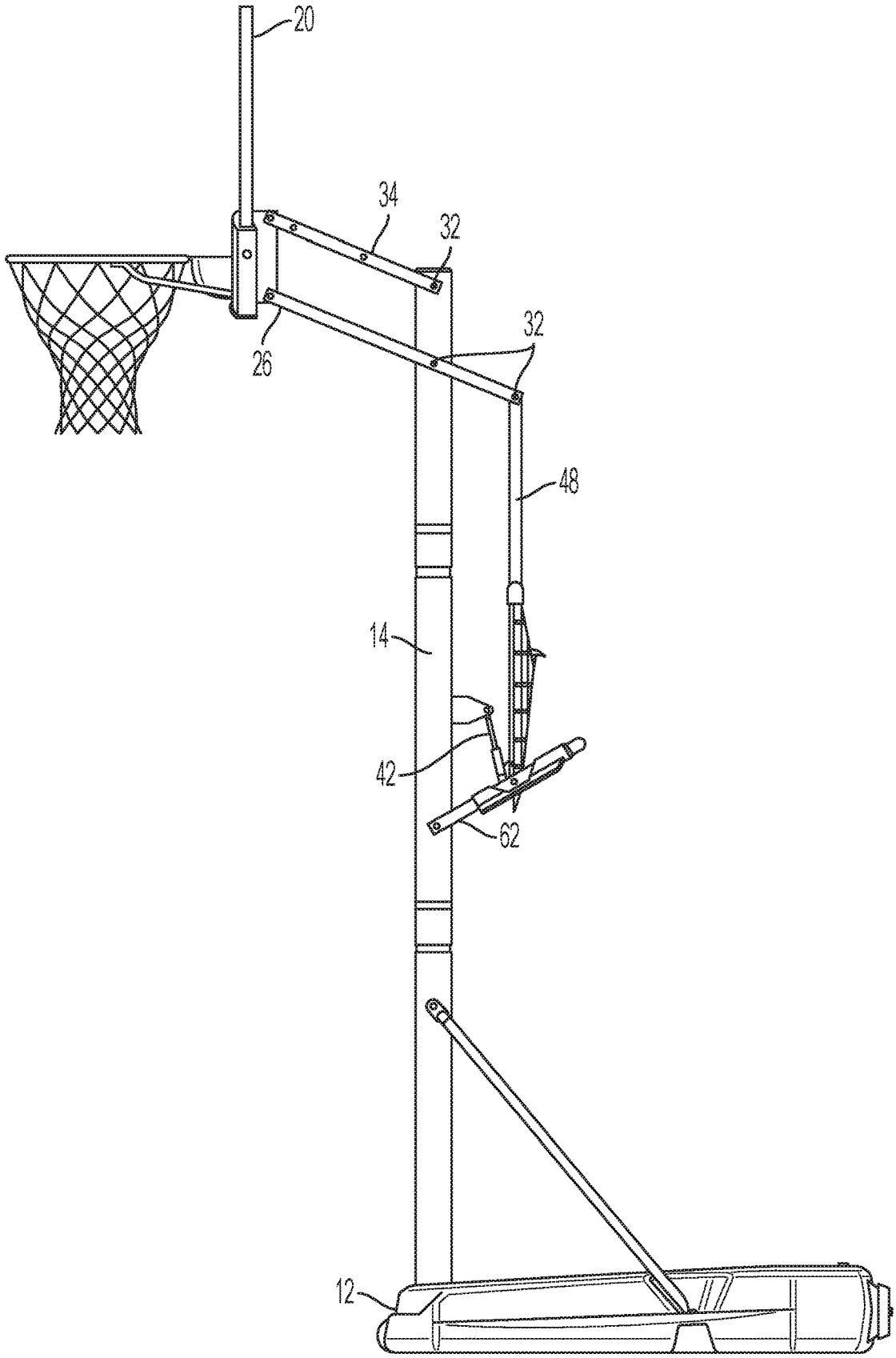
FIG. 5 depicts another embodiment of the lift system disclosed herein.

Another embodiment is depicted in FIG. 5. In this embodiment, the orientation of the lower strut 42 relative to the pole 14 and lock housing 54 is reversed. In embodiments such as those described with reference to FIGS. 1 and 5, the lower strut 42 is in tension in a static state. This is because the weight of the backboard assembly 20, when left unbalanced by the locking force of the spring 56, tends to pull drop downward on the front side of the pole 14. This results in the proximal end 30 of the primary arm 26 pulling the elevator assembly 40 upward. In the embodiments of FIGS. 1 and 4, the lower strut 42 is thus pulled upward and placed in tension. In FIG. 5, the lower strut 42 is oriented such that the upper end 46 is attached to the pole 14, and the lower end 44 is free. Thus, the balancing forces place the lower strut 42 in compression.

Figure 6:
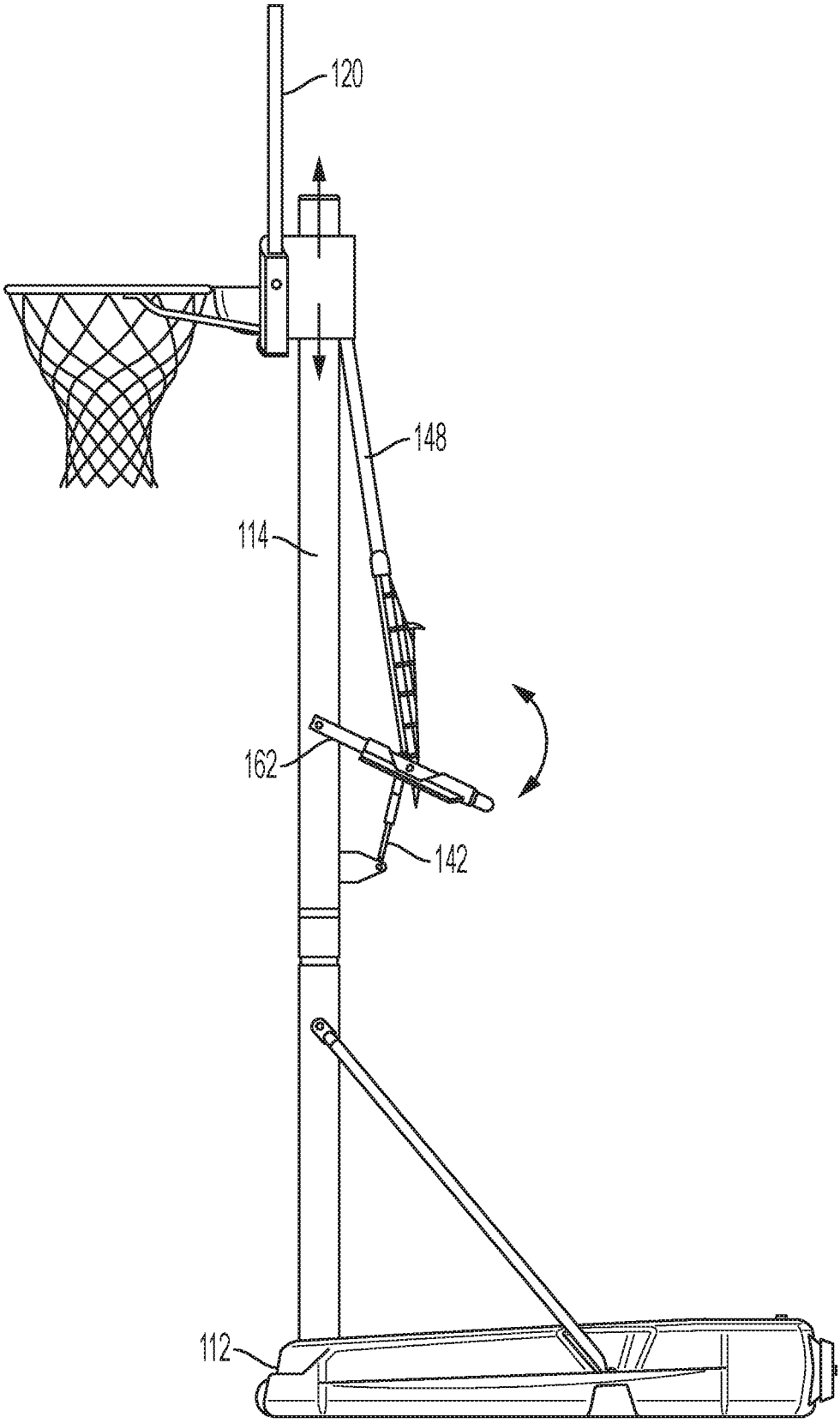
FIG. 6 depicts another embodiment of the lift system disclosed herein.

FIG. 6 depicts another embodiment of an assembly with an elevator mechanism. In this embodiment, the elevator assembly and the backboard assembly 120 move up and down in the same direction, rather than in opposite directions as shown in FIGS. 1, 4, and 5. In assembly, a pole 114 is provided as secured into the ground. Per the embodiment shown in FIG. 1, the pole may also be secured to a portable base 112 in this embodiment in FIG. 6. In FIG. 6 the backboard assembly is connected to a collar that slides up and down the pole 114. As the upper strut 148 moves upward, it pushes the collar upward. The backboard is secured to the collar, and the goal is secured to the front of the backboard 124. The lock housing attaches to the lower strut 142 and is operated by the handle 162. These may be any of the variations in the elevator assemblies as described above with reference to FIGS. 1-5. Thus, the primary difference in the embodiment of FIG. 6 is that the backboard assembly 120 is not pinned to the pole 114 and instead moves upward or downward in the same direction as the upper strut 148 when the upper strut 148 is moved.

It is to be understood that any given elements of the disclosed embodiments of the invention may be embodied in a single structure, a single step, a single substance, or the like. Similarly, a given element of the disclosed embodiment may be embodied in multiple structures, steps, substances, or the like.

The foregoing description illustrates and describes the processes, machines, manufactures, compositions of matter, and other teachings of the present disclosure. Additionally, the disclosure shows and describes only certain embodiments of the processes, machines, manufactures, compositions of matter, and other teachings disclosed, but, as mentioned above, it is to be understood that the teachings of the present disclosure are capable of use in various other combinations, modifications, and environments and are capable of changes or modifications within the scope of the teachings as expressed herein, commensurate with the skill and/or knowledge of a person having ordinary skill in the relevant art. The embodiments described hereinabove are further intended to explain certain best modes known of practicing the processes, machines, manufactures, compositions of matter, and other teachings of the present disclosure and to enable others skilled in the art to utilize the teachings of the present disclosure in such, or other, embodiments and with the various modifications required by the particular applications or uses. Accordingly, the processes, machines, manufactures, compositions of matter, and other teachings of the present disclosure are not intended to limit the exact embodiments and examples disclosed herein. Any section headings herein are provided only for consistency with the suggestions of 37 C.F.R. § 1.77 or otherwise to provide organizational queues. These headings shall not limit or characterize the invention(s) set forth herein.

I claim:

1. A basketball goal system comprising:

a) a vertical support;

b) a backboard support assembly having a top arm with a proximal end coupled to a backboard and a distal end rotatably connected to the vertical support, and a bottom arm with a proximal end coupled to the backboard and a middle section rotatably coupled to the vertical support;

c) an elevator assembly comprising i) a lower strut having a lower end affixed to the vertical support; ii) a spring assembly having a spring expandably coiled around the lower strut, and a housing containing the spring;

iii) an upper strut having an upper end rotatably connected to a distal end of the bottom arm and a lower end coupled to the housing; and iv) a handle pivotally attached to the vertical support and pivotally attached to the housing, and having a spring trigger configured to expand the spring when triggered and contract the spring when released.

2. The system of claim 1, wherein the vertical support comprises a pole.

3. The system of claim 2, wherein the vertical support further comprises a portable base.

* * * * *